US005118594A

United States Patent [19]

Lestina et al.

[11] Patent Number: 5,118,594

[45] Date of Patent: Jun. 2, 1992

[54] PHOTOGRAPHIC ELEMENTS CONTAINING REMOVABLE COUPLERS

[75] Inventors: Gregory J. Lestina, Rochester; Jon D. Bass, Webster; John W. Harder, Rochester; Stephen P. Singer, Spencerport, all of N.Y.

[73] Assignee: Eastman Kodak Company, Rochester, N.Y.

[21] Appl. No.: 693,994

[22] Filed: Apr. 29, 1991

Related U.S. Application Data

[62] Division of Ser. No. 366,953, Jun. 16, 1989, Pat. No. 5,051,343.

[51] Int. Cl.[5] ..... G03C 7/30; G03C 7/32

[52] U.S. Cl. ..... 430/393; 430/222; 430/376; 430/543; 430/223; 430/558

[58] Field of Search ..... 430/222, 226, 223, 543, 430/546, 558 R, 376, 393, 223, 558 A

[56] References Cited

U.S. PATENT DOCUMENTS

| | | | |
|---|---|---|---|
| 2,306,410 | 12/1942 | Schinzel | 430/543 |
| 2,353,754 | 9/1944 | Peterson | 430/543 |
| 2,412,700 | 12/1946 | Weissberger et al. | 430/543 |
| 2,756,142 | 7/1956 | Yutzy | 430/222 |
| 3,087,817 | 4/1963 | Rogers | 430/222 |
| 3,537,850 | 11/1970 | Simon | 430/543 |
| 3,676,124 | 7/1972 | Ohkubo et al. | 430/226 |
| 3,734,726 | 5/1973 | Figueras et al. | 430/223 |
| 3,865,593 | 2/1975 | Yeshida et all. | 430/543 |
| 4,076,529 | 2/1978 | Fleckenstein et al. | 430/223 |
| 4,139,379 | 2/1979 | Chasman et al. | 430/226 |
| 4,350,752 | 9/1982 | Reczek et al. | 430/219 |
| 4,358,525 | 11/1982 | Mcoberry et al. | 430/217 |
| 4,410,618 | 10/1983 | Vanmeter et al. | 430/219 |
| 4,477,563 | 10/1984 | Ichijima et al. | 430/544 |
| 4,543,323 | 9/1985 | Iijima et al. | 430/503 |

*Primary Examiner*—Richard L. Schilling
*Attorney, Agent, or Firm*—Joshua G. Levitt

[57] ABSTRACT

This invention relates to novel photographic dye-forming coupler compounds which are non-diffusible as incorporated in a photographic element, but which, during processing, are converted to a form which is removable from the element if the coupler compound has not reacted with oxidized silver halide color developing agent.

9 Claims, No Drawings

PHOTOGRAPHIC ELEMENTS CONTAINING REMOVABLE COUPLERS

This is a division of application Ser. No. 366,953 filed Jun. 16, 1989 now U.S. Pat. No. 5,051,343.

This invention relates to color photography. In a particular aspect it relates to novel dye-forming couplers and to photographic elements containing them.

Color photographic images are commonly formed by a reaction between oxidized silver halide developing agent and a dye-forming compound commonly called a coupler. This type of reaction has been used from the time of the earliest commercially viable color photographic materials. Early materials employed a photographic element containing light-sensitive silver halide emulsion layers. The coupler compound was introduced into the element during processing after imagewise exposure. Materials intended for use in this way continue to be sold under the Kodachrome trademark.

Such materials provide extremely sharp and stable images. A disadvantage of such materials is the complexity of the development sequence necessitated by the use of couplers in the processing compositions. As a result, there were developed photographic materials in which the coupler compound is incorporated during the manufacture in the layer in which the dye is to be formed. This simplifies the processing significantly. However, there remains in the processed element unreacted coupler as an inverse function of dye formation. Such unreacted coupler increases the thickness of the layer in which it remains; hence, it can reduce the sharpness of the image. More significantly, unreacted coupler can deteriorate or undergo side reactions on keeping. This provides a potential for a change in density of the background areas of the image with time.

Accordingly, it would be desirable to provide couplers, and photographic elements containing them, in which unreacted coupler can be removed from the element during photographic processing.

This invention provides novel photographic couplers which accomplish this.

In accordance with this invention there is provided a photographic element comprising a support, a silver halide emulsion, and a non-diffusible coupler compound that during photographic processing is converted to a form that can be removed from the element unless it reacts with oxidized silver halide developing agent to form a dye.

Conversion from the non-diffusible form to the removable form can occur in the development step, although preferably the coupler and processing are designed for it to occur in a subsequent step. Removal can occur in the same processing step as conversion, although it preferably occurs in a separate, subsequent step. Conversion and removal can occur in one of the existing processing steps, but preferably one or both occur in an additional step or steps added to the processing sequence specifically for that purpose.

Conversion of the coupler to the removable form can involve reducing the bulk and/or increasing the solubility of the coupler. This can be accomplished by the removal of a ballast group or the unblocking of a solubilizing group or both. This can take place on a portion of the coupler molecule in a non-coupling or coupling position. It is preferable for such reactions to occur at some position on the coupling-off group, i.e., the group which is displaced when the coupler reacts with oxidized developing agent. The product which results from the conversion reaction should remain in the removable form for at least as long as required to be removed from the element. Thereafter, the compound can stay in the converted form, revert to the original form, or go to a new form, depending upon the particular reactions involved.

Couplers useful in this invention can be represented by the structure:

COUP—LS—BAL where:

COUP is a coupler moiety;

LS is a splittable linking group attached to a coupling or non-coupling position of COUP; and BAL is a ballast group.

Upon development, the coupler moiety will react with oxidized color developing agent (DOX). Also, during processing, the linking group splits to detach the ballast from the remainder of the molecule. Various reaction products are possible depending on the particular type of coupler moiety employed, the position on the coupler moiety to which the linking group is attached, and the particular linking group employed.

If the linking group is attached to a non-coupling position, reaction of the coupler compound with oxidized developing agent will yield a reaction product having the structure $$\begin{array}{l}\text{COUP—LS'},\\ \quad\;\;|\\ \quad\text{DOX}\end{array} \qquad 1)$$

while splitting of the linking group without reaction with oxidized color developing agent will yield a product having the structure:

$$\text{COUP—LS'} \qquad 2)$$

where LS' is the residue of the splittable linking group and can be a solubilizing group, or not.

If the linking group is attached to a coupling position of the coupler moiety, the reaction products will have the structures:

$$\begin{array}{l}\text{COUP}\\ \;\;|\\ \text{DOX}\end{array} \qquad 3)$$

where the coupler has reacted with oxidized developing agent, and the structure $$\begin{array}{l}\text{COUP}\\ \;\;|\\ \text{LS'}\end{array} \qquad 4)$$

where it has not.

In all instances, COUP and LS' should be such that products 2 and 4 are removable from the element during processing. This is accomplished by reduction in bulk resulting from cleavage of the ballast group, or by unmasking of a solubilizing group in LS', or both.

Preferably, COUP is chosen so that products 1 and 3 are non-diffusible image forming dyes. However, COUP can be chosen so that products 1 or 3 is slightly mobile to result in image smearing as described in U.S. Pat. Nos. 4,420,556 and 4,489,155.

If the splittable linking group is attached to a non-coupling position of the coupler moiety, there can be attached to the coupling position a group that upon coupling will be released for a photographic effect. Alternatively, the coupling position can be substituted with a non-removable group that will permit a leuco dye to be formed on reaction with oxidized color developing agent, thereby providing a scavenger compound which competes for oxidized color developing agent. In both these cases it may be advantageous for COUP to be chosen so that product 1 is removed from the element during processing.

The coupler moiety represented by COUP can be derived from any of the couplers known in the art which are of suitable bulk and solubility. Preferred are cyan, magenta and yellow dye forming coupler moieties which yield a non-diffusible dye on reaction with oxidized color developing agent, although other coupler moieties can be employed, such as those which yield a colorless or diffusible reaction product with oxidized color developing agent.

There follows a listing of patents and publications from which useful coupler moieties can be selected.

Couplers which form cyan dyes upon reaction with oxidized color developing agent are described in such representative patents and publications as: U.S. Pat. Nos. 2,772,162; 3,476,563; 4,526,864; 4,500,635; 4,254,212; 4,296,200; 4,457,559; 2,895,826; 3,002,836; 3,034,892; 2,474,293; 2,801,171; 2,423,730; 2,367,531; 3,041,236; 4,443,536; 4,333,999; 4,124,396; 4,775,616; 3,779,763; 3,772,002; 3,419,390; 4,690,889; 3,996,253; and "Farbkuppler-eine Literaturübersicht," published in Agfa Mitteilungen, Band III, pp. 156–175 (1961).

Such couplers typically are phenols and naphthols.

Couplers which form magenta dyes upon reaction with oxidized color developing agent are described in such representative patents and publications as: U.S. Pat. Nos. 2,600,788; 2,369,489; 1,269,479; 2,311,082; 3,061,432; 3,725,067; 4,120,723; 4,500,630; 2,343,703; 2,311,082; 3,152,896; 3,519,429; 3,062,653; 2,908,573; 4,774,172; 4,443,536; 3,935,015, 4,540,654; 4,581,326; European Patent Applications 284,239; 284,240; 240,852; 170,164; 177,765; and "Farbkuppler-eine Literaturübersicht," published in Agfa Mitteilungen, Band III, pp. 126–156 (1961).

Typically, such couplers are pyrazolones, pyrazolotriazoles, pyrazolobenzimidazoles; or indazoles.

Couplers which form yellow dyes upon reaction with oxidized and color developing agent are described in such representative patents and publications as: U.S. Pat. Nos. 3,384,657; 3,415,652; 3,542,840; 4,046,575; 3,894,875; 4,095,983; 4,182,630; 2,875,057, 2,407,210, 3,265,506; 2,298,443, 3,408,194; 3,447,928; 4,587,207; 4,617,256; 4,587,205; 4,529,691; 4,443,536; 4,326,024; 4,203,768; 4,221,860; 3,933,501; 4,022,620; 4,401,752; European Patent Application 296,793; and "Farbkuppler-eine Literaturübersicht," published in Agfa Mitteilungen, Band III, pp. 112–126 (1961).

Typically, such yellow dye forming couplers are acylacetamides, such as benzoylacetanilides and pivalylacetanilides.

Couplers which form colorless products upon reaction with oxidized color developing agent are described in such representative patents as: U.K. Patent No. 861,138; U.S. Pat. Nos. 3,632,345, 3,928,041; 3,958,993; and 3,961,959.

In those instances where LS is not joined to the coupling position, there can be attached to the coupling position a photographically useful group, such as a development inhibitor or a development accelerator. Patents describing such couplers include: U.S. Pat. Nos. 3,148,062; 3,227,554; 4,248,962; 4,409,323; 4,477,563; 4,684,604; 4,737,451; and 4,782,012.

The ballast group represented by BAL can be any group of sufficient size and bulk that, with the remainder of the molecule, renders the unreacted coupler immobile prior to processing. It can be a relatively small group if the remainder of the group is relatively bulky. For example, if splitting of LS unmasks a solubilizing group, BAL need not be very bulky if the coupler compound as a whole is non-diffusible. When detached from COUP, the ballast moiety can be mobile and wash out of the element during processing or it can be immobile and remain in the element. If the ballast moiety is a polymer, from which the coupler moiety is appended, further advantages in the element could be obtained if the polymer eliminated the need for coupler solvent or alternative means of dispersing the coupler in the element. This would have a thinning effect on the entire element which could provide sharpness and image keeping improvements.

Splitting of the linking group, LS, typically occurs by a hydrolysis reaction which is initiated by a component of one of the processing solutions (e.g. an acid or a base). This reaction can be assisted by a group on the coupler moiety, the ballast group and/or the linking group, or by a group which is a separate component of one of the processing compositions (e.g. a nucleophile).

An exemplary reaction is the hydrolysis of an ester. For example, an imidomethyl ester or a beta- or gamma-keto ester can be hydrolyzed in the presence of base and the reaction can be accelerated by the presence of a nucleophile, such as hydroxylamine. Similarly, acetal and ketal protecting groups can be hydrolyzed in the presence of acid. In other instances hydrolysis is preceded by a separate oxidation or reduction reaction, such as the oxidation of a hydrazide group or of a sulfonamidophenol. The reactions can be anchimerically assisted.

Representative reaction schemes are illustrated below. In these reactions the unsatisfied bond represents the point of attachment to the coupler, or to a group which is attached to the coupler, and R is a generalized representation of hydrogen or appropriate substituents. Typically, one of the R substituents will be the ballast group.

a) Hydrolysis of a phthalimidomethyl ester:

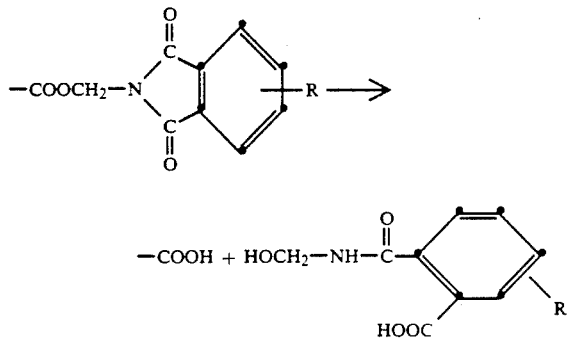

b) Hydrolysis of a keto ester:

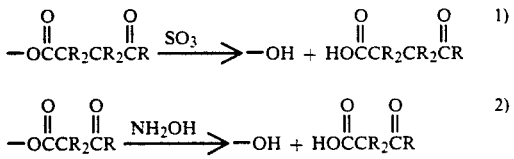

c) Oxidative cleavage of a diketone:

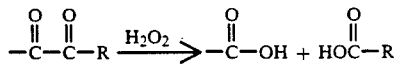

d) Hydrolysis of a ketal or acetal:

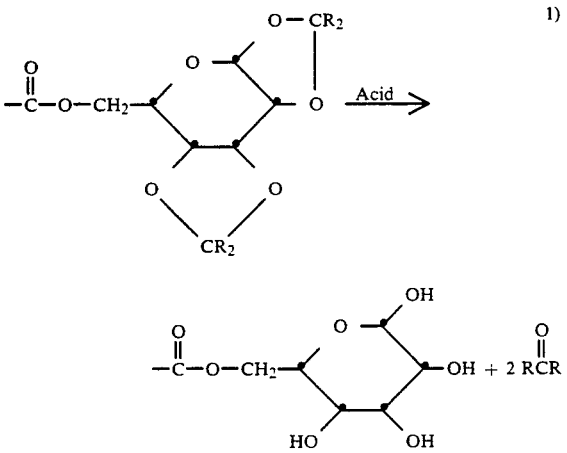

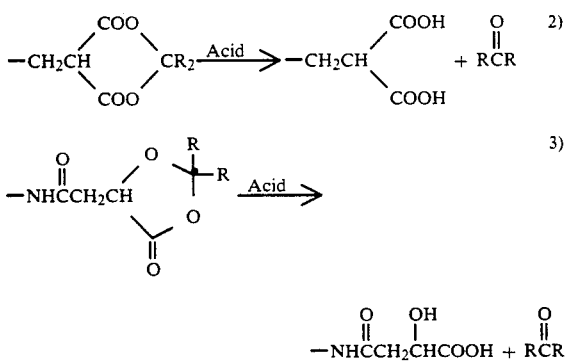

e) Hydrolysis following oxidation:

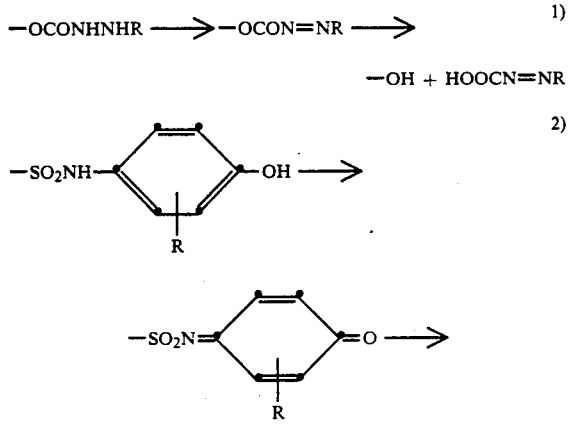

-continued

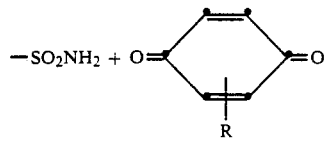

f) Fluoride-catalyzed siloxy bond cleavage:

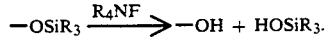

g) Anchimerically assisted base-catalyzed hydrolysis:

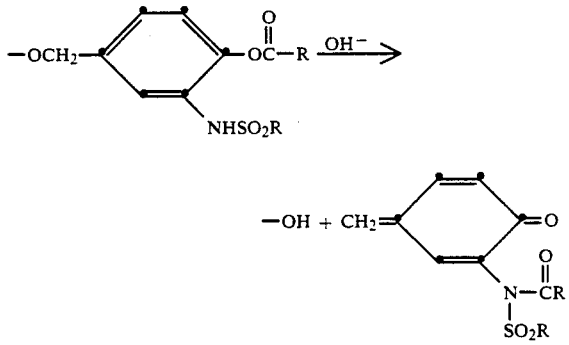

Preferred couplers of this invention can be represented by the structure:

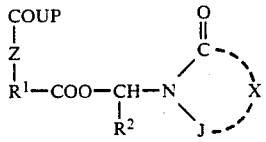

wherein: COUP is as defined above;

Z is joined to the coupling position of COUP and is O or S or a nitrogen of a heterocylic ring;

$R^1$ is alkylene of 1 to 10 carbon atoms or arylidene of 6 to 16 carbon atoms;

$R^2$ is hydrogen, alkyl of 1 to 4 carbon atoms or aryl of 6 to 12 carbon atoms;

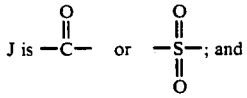

X represents the atoms to complete a 5- or 6- membered ring or ring system moiety.

In the above structural formula the moiety X, together with the group represented by J, can complete a mono-, bi- or tri-cyclic ring or ring system each ring of which contains 5 to 6 members. A preferred ring system is the phthalimide (1,3-isoindolinedione) ring system. Other useful ring systems include saccharin, (1,2-benzisothiazolin-3-one-1,1-dioxide), succinimide, maleimide, hydantoin, 2,4-thiazolidinedione, hexahydro-2,4-pyrimidinedione, 1,4-dihydrophthalimide, and the like. These rings can be unsubstituted or substituted.

Especially preferred are couplers represented by the structures

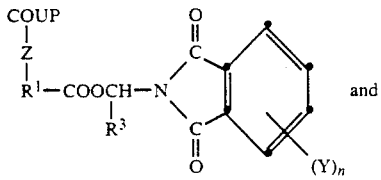

and

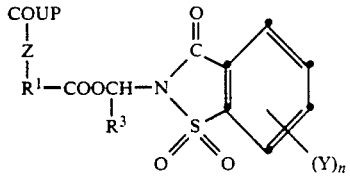

wherein

COUP, Z, and $R^1$ are as defined above;

$R^3$ is hydrogen or alkyl of 1 to 4 carbon atoms;

n is 0 to 3; and

Y is a substituent.

Suitable substituents include halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, aminocarbonyl, aminosulfonyl, carboxy, alkoxycarbonyl, aryloxycarbonyl, alkenyloxycarbonyl and the like. The alkyl portions of these substituents contain from 1 to about 30 carbon atoms, the alkenyl portions of these substituents contain from 2 to about 30 carbon atoms, and the aryl portions of these substituents contain from 6 to about 30 carbon atoms. The alkyl, aryl and alkenyl portions of these substituents can be further substituted with groups of the type specified above. Thus, alkyl is inclusive of, e.g. aralkyl and aryloxyalkyl, aryl is inclusive of, e.g., alkaryl and alkoxyaryl.

Representative couplers of this invention have the following structures:

1

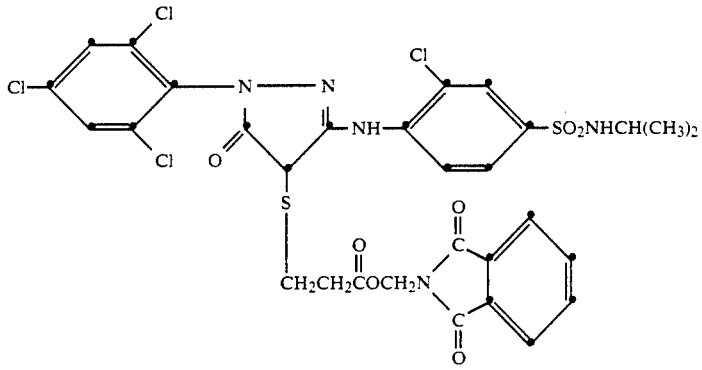

2

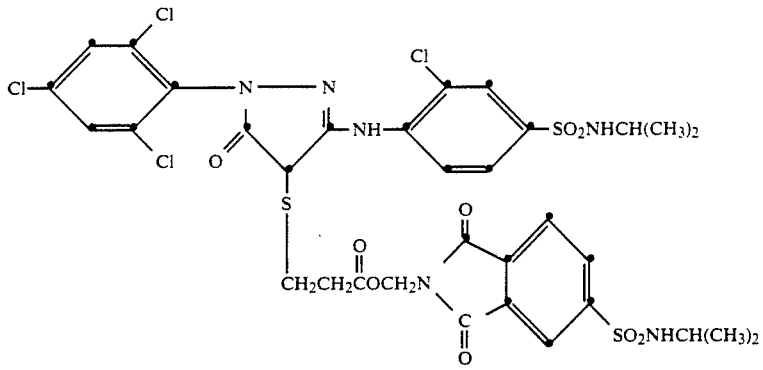

3

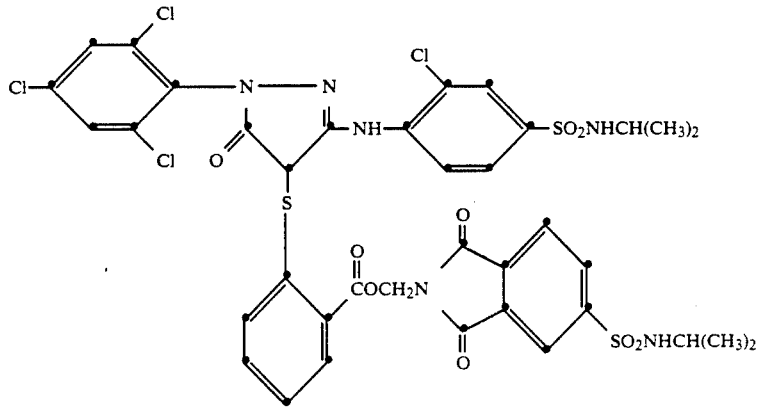

-continued
4
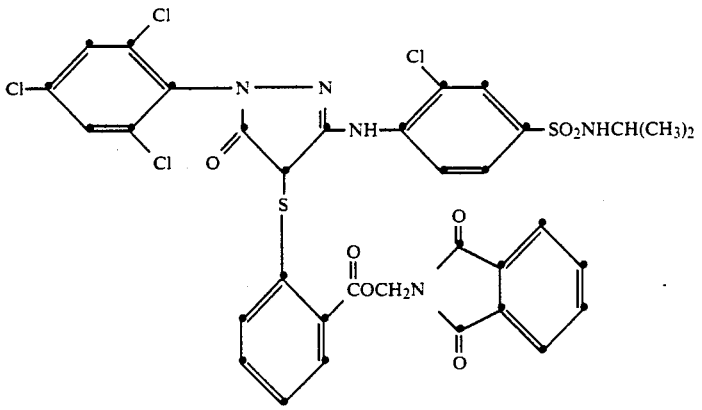
5
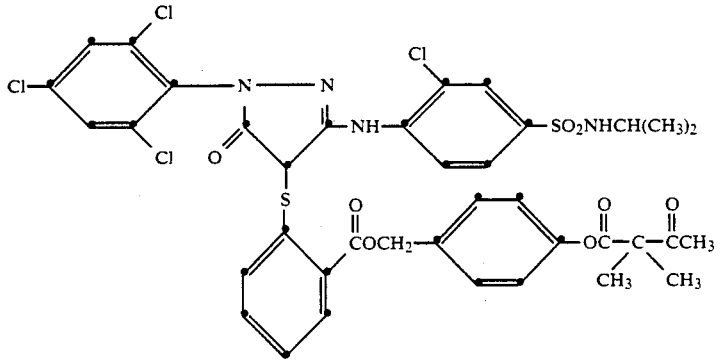
6
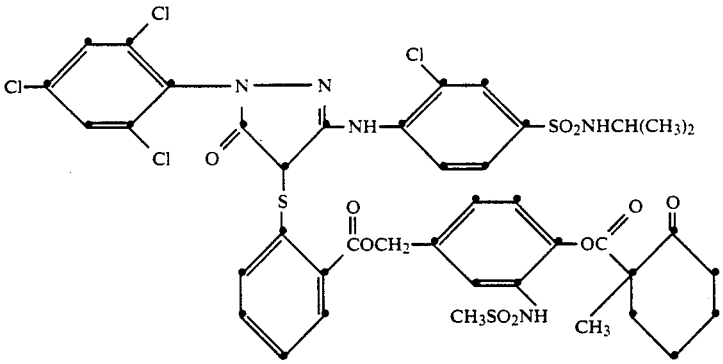
7
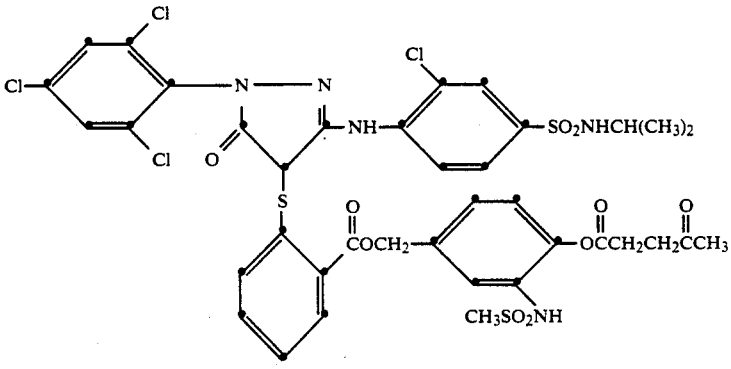

-continued
8
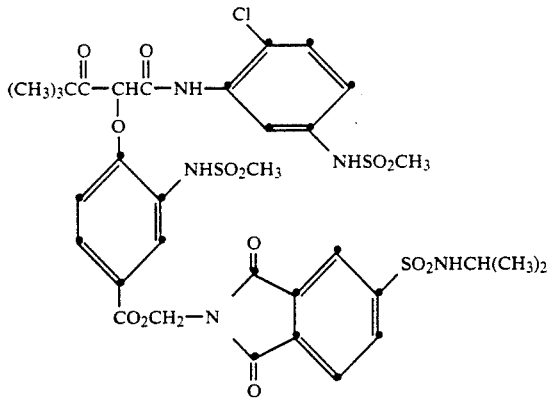
9
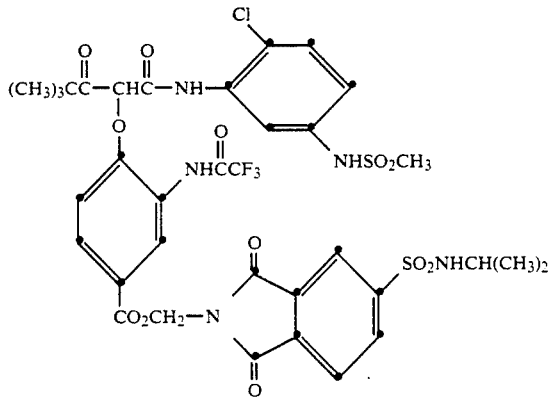
10
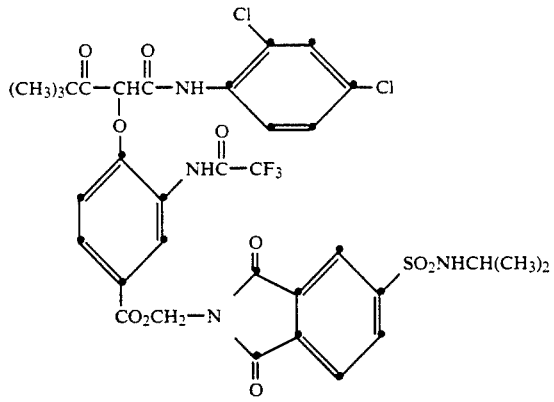
11
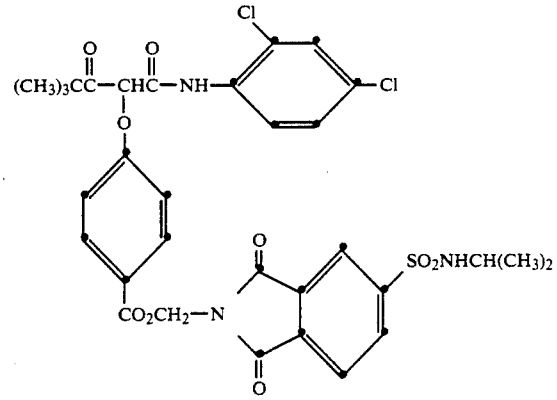

-continued
12
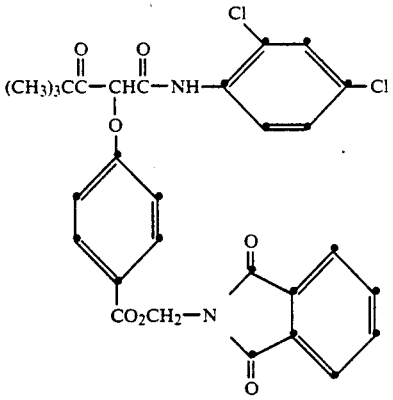
13
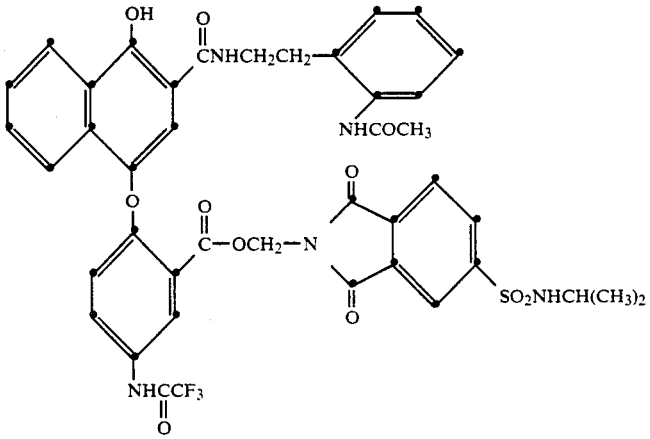
14
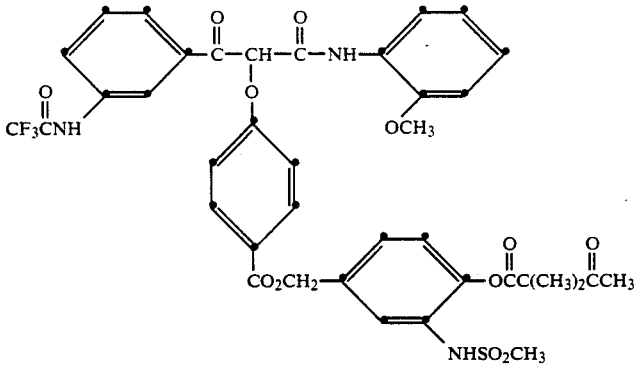
15
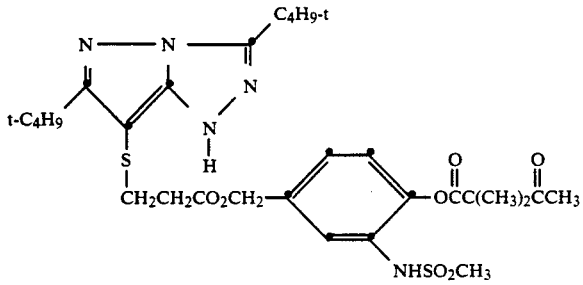

-continued
16
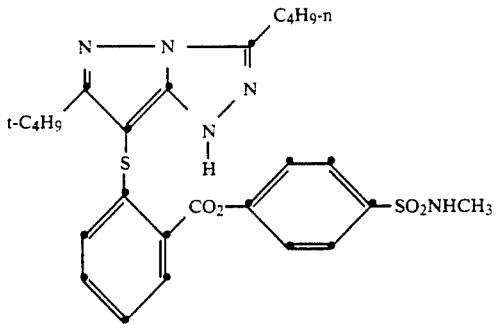
17
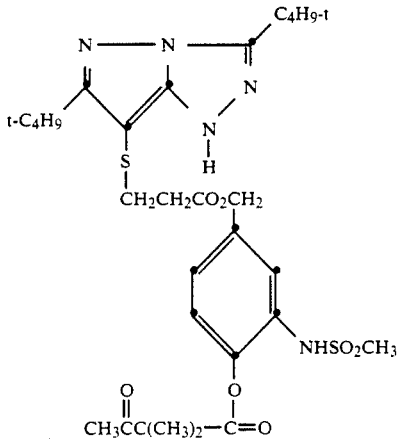
18
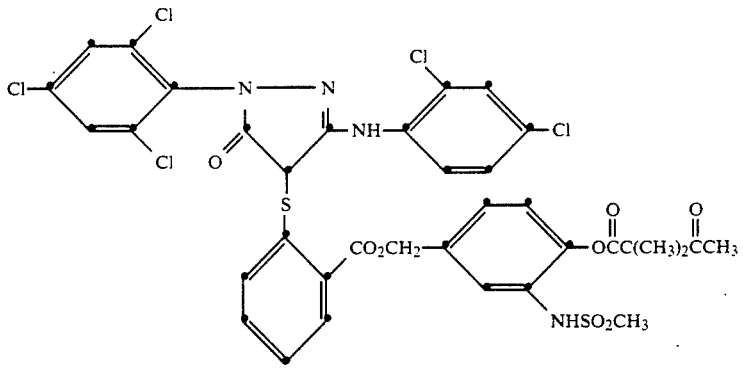
19
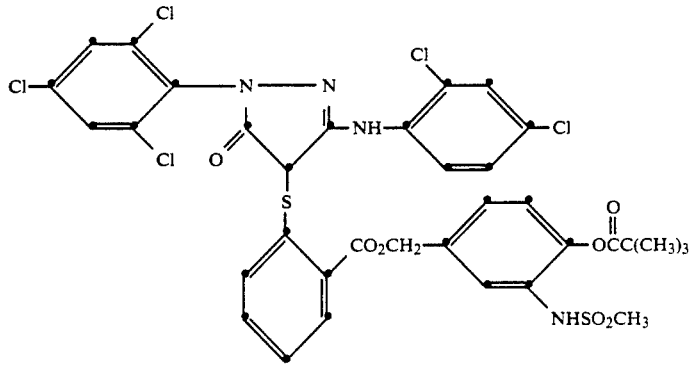

-continued
20
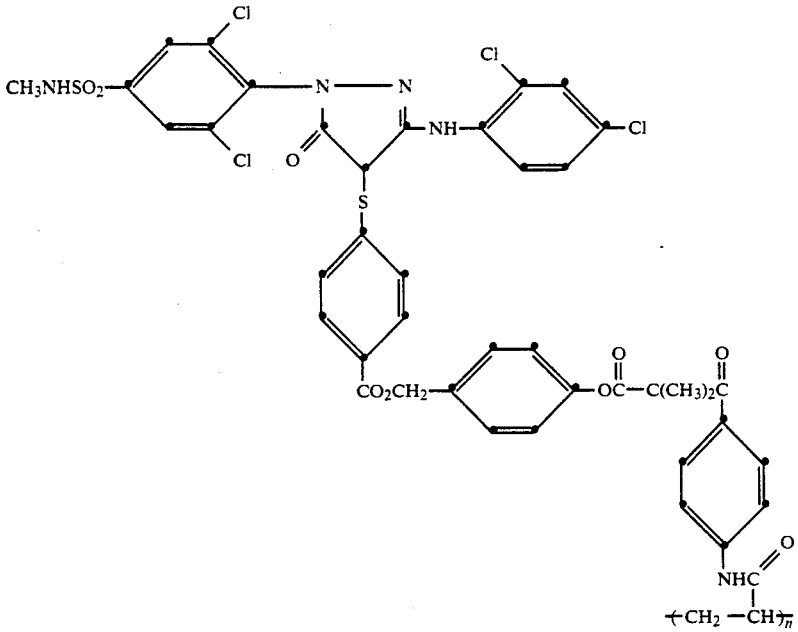
21
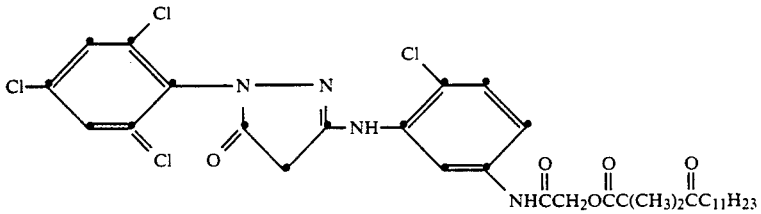
22
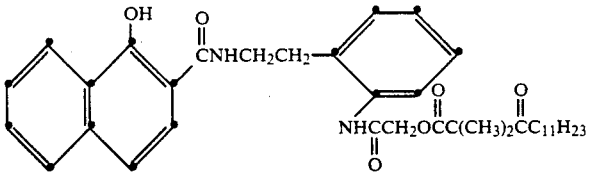
23
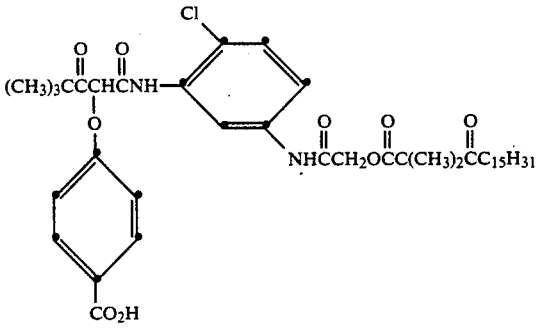

-continued
24
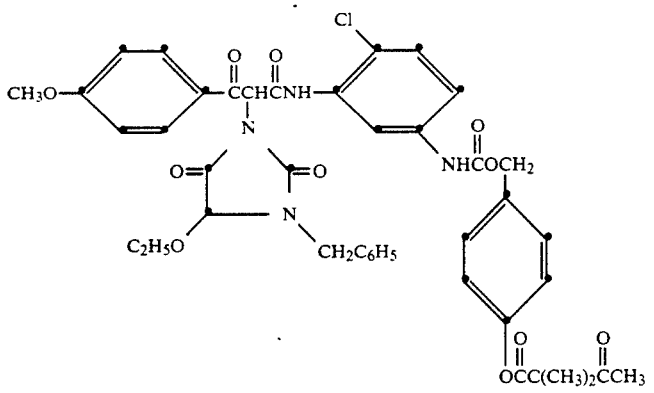
25
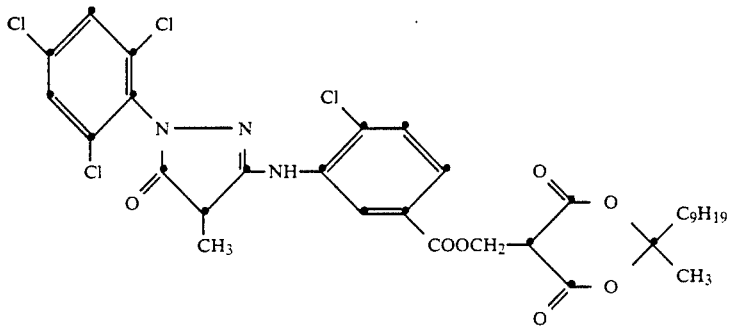
26
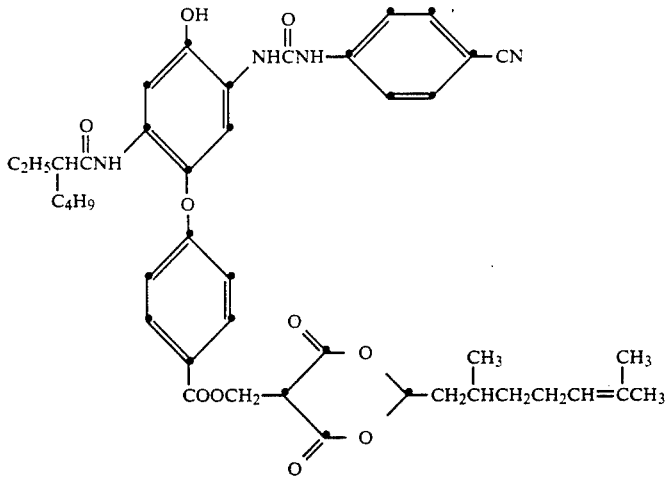
27
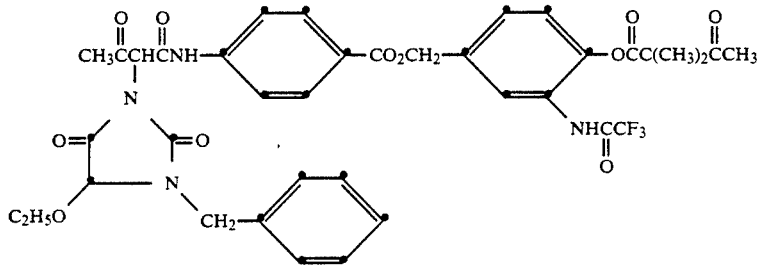

-continued
28
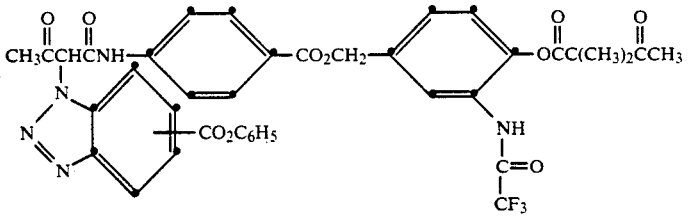
29
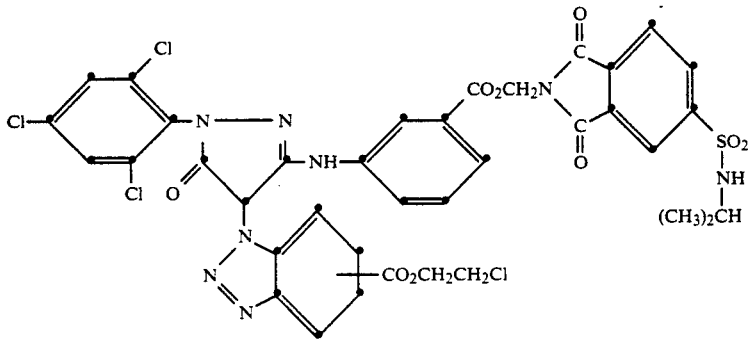
30
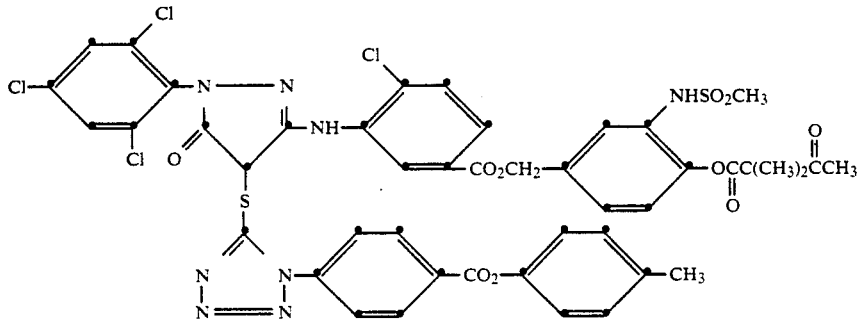
31
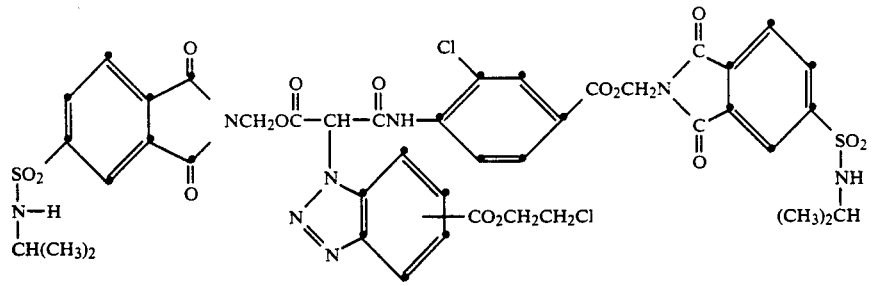
32
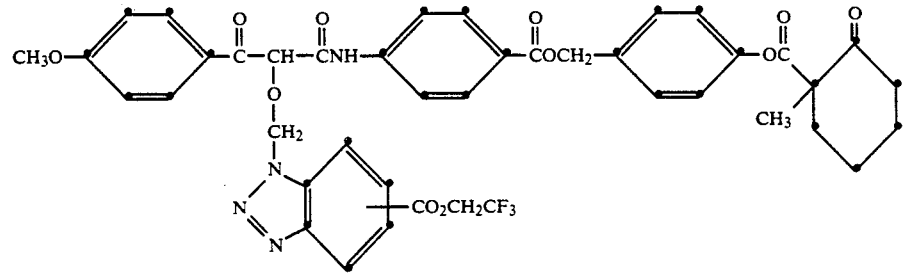

-continued
33
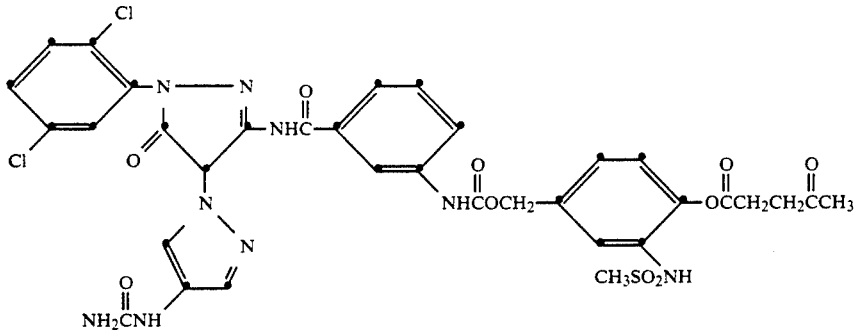
34
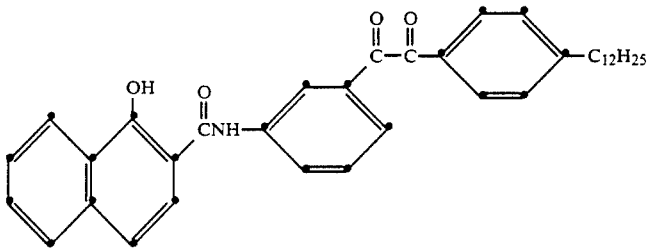
35
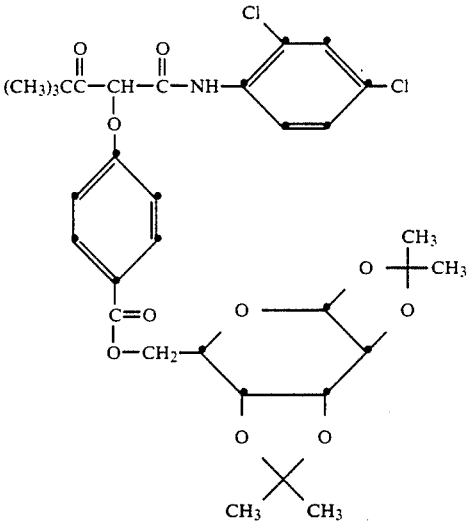
36
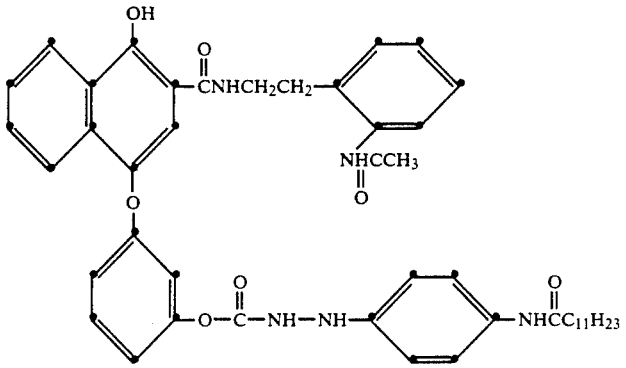

-continued

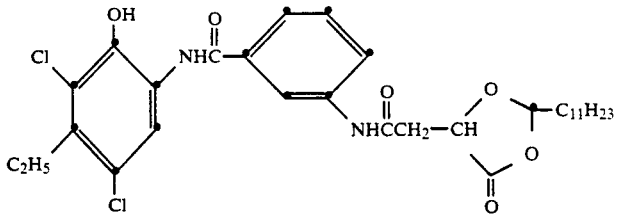

Couplers of this invention can be prepared by sequential stepwise reactions in which there is attached to a preformed coupler moiety the entire —LS—BAL group or the LS group followed by the BAL group. The preparation of representative couplers shown in the following synthesis examples is illustrative of synthetic techniques that can be employed.

Representative syntheses are as follows:

SYNTHESIS EXAMPLE 1: PREPARATION OF COUPLER 1

Part A: Preparation of Disulfide S-3

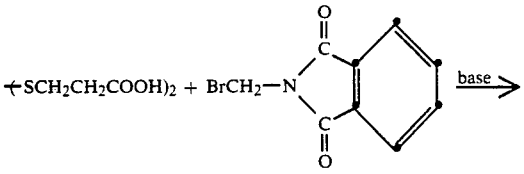

S-1 S-2

-continued

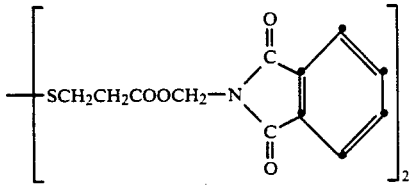

S-3

2.1 g (0.01 mole) of S-1 and 5 g (0.021 mole) of S-2 were mixed in 50 ml of dry tetrahydrofuran (THF) containing 4 g (0.03 mole) of N,N-diisopropylethylamine (Hunig's base) and stirred overnight at room temperature (~20° C.). The reaction mixture was then drowned in water and the precipitate which formed was collected and crystallized from acetonitrile to give 4 g (0.0076 mole) of the white solid, S-3. m.p. 121.5°-122° C.

The NMR spectrum was consistent with the assigned structure. Anal. calcd. for $C_{24}H_{20}N_2O_8S_2$: C, 54.5; H, 3.8; N, 5.3. Found: C, 54.5; H, 3.8; N, 5.2.

Part B: Preparation of the Coupler

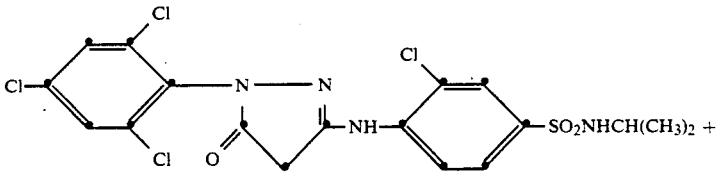

Coupler M

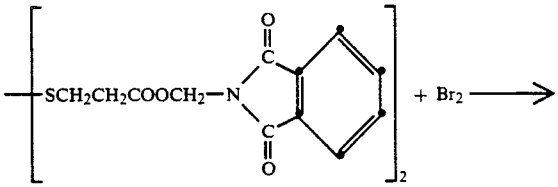

S-3

-continued

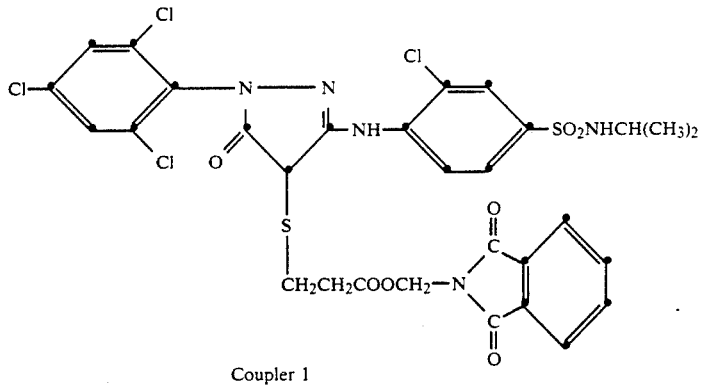

Coupler 1

5.3 g (0.01 mole) of coupler M and 5.8 g (0.0055 mole) of the disulfide S-3 were dissolved in 75 ml of dry dimethylformamide (DMF) at room temperature. To this stirred solution was added dropwise 1 g of $Br_2$ in 5 ml of DMF. This solution was stirred overnight during which time it had turned green. The solution was drowned in water containing sodium chloride, a gummy solid was collected by decantation, dissolved in ether, and the ether washed three times with water, dried, and concentrated to a green glass under reduced pressure. The resulting material was dissolved in dichloromethane and chromatographed on magnesium silicate. The desired fractions were obtained by eluting with a 9:1 mixture of dichloromethane: ethyl ether. While on concentration of the appropriate solutions, a solid formed which was collected and recrystallized from acetonitrile to give 4 g (0.0052 mole) of off-white solid Coupler 1, m.p. 132°-4° C.

The NMR spectrum was consistent with the assigned structure. Anal. Calcd. for $C_{30}H_{25}Cl_4N_5O_7S_2$: C, 46.6; H, 3.3; N, 9.1. Found: C, 45.4; H, 3.2; N, 8.7.

SYNTHESIS EXAMPLE 2: PREPARATION OF COUPLER 2

Part A: Preparation of Disulfide S-5

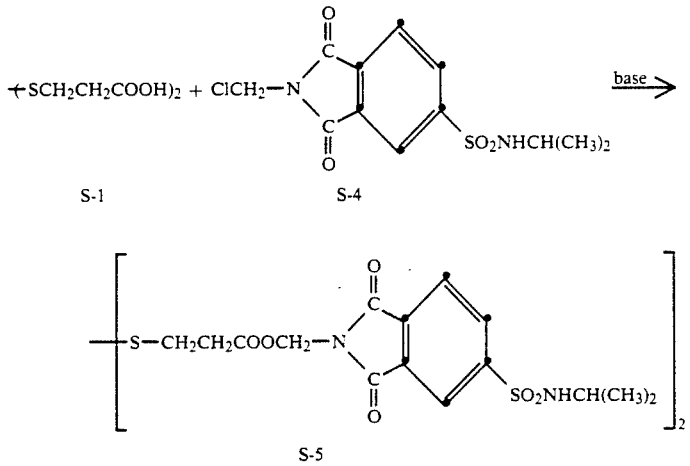

S-1 S-4 S-5

10 g (0.048 mole) of S-1 and 29 g (0.096 mole) of S-4 were mixed in dry DMF containing 18 g of Hunig's base and the solution stirred overnight. The following day the reaction mixture was drowned in water containing NaCl and a gummy solid was collected which crystallized upon trituration with ethyl acetate. The material was recrystallized from acetonitrile to give 13 g (0.017 mole) of white solid S-5, m.p. 158°-160° C.

Anal. calcd. for $C_{30}H_{34}N_4O_{12}S_4$: C, 46.7; H, 4.4; N, 7.3. Found: C, 47.0; H, 4.4; N, 7.2.

Part B: Preparation of the Coupler

Coupler M + S-5 + $Br_2$ ⟶

-continued

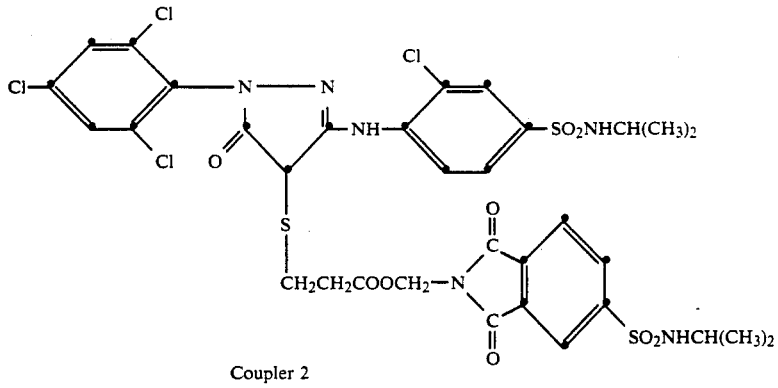

Coupler 2

Part B of Synthesis Example 1 was repeated using 10.2 g (0.02 mole) of Coupler M and 8.5 g (0.011 mole) of disulfide S-5. The crude product was isolated as a pale green glass which after solution in dichloromethane followed by flash chromatography on $SiO_2$ gave an almost colorless glass. Trituration of the product with diisopropyl ether gave 5 g (0.0056 mole) of Coupler 2 as a granular solid, m.p. 120°-123° C.

SYNTHESIS EXAMPLE 3: PREPARATION OF COUPLER 3

Part A: Preparation of Disulfide S-7

15.3 g (0.05 mole) of S-6 and 33 g (0.11 mole) of S-4 were dissolved in 250 ml of dry DMF containing 15 g (0.12 mole) of Hunig's base and the solution was stirred overnight. The solution was drowned in water containing NaCl and a solid was collected. Trituration of this material with chloroform gave a 21.7 g (0.025 mole) of white solid S-7, m.p. >220° C.

The mass spectrum was consistent with the assigned structure. Anal. calcd. for $C_{38}H_{34}N_4O_{12}S_4$: C, 52.6; H, 4.0; N, 6.5. Found: C, 51.9; H, 4.0; N, 6.3.

Part B: Preparation of the Coupler

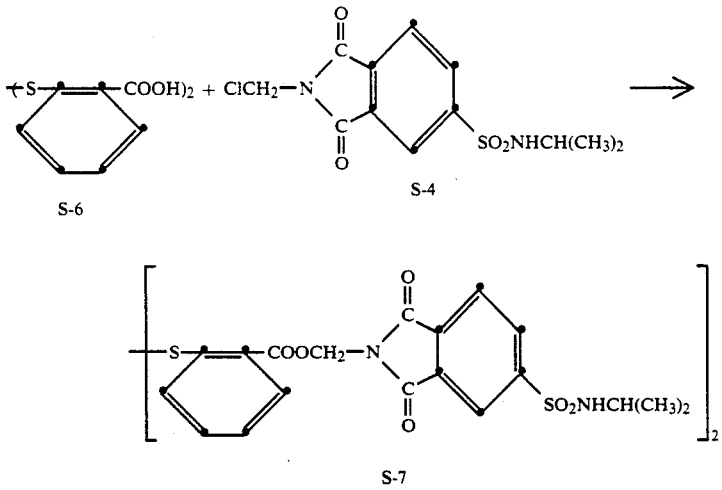

S-6 S-4 S-7

Coupler M + S-7 + $Cl_2$ ⟶

-continued

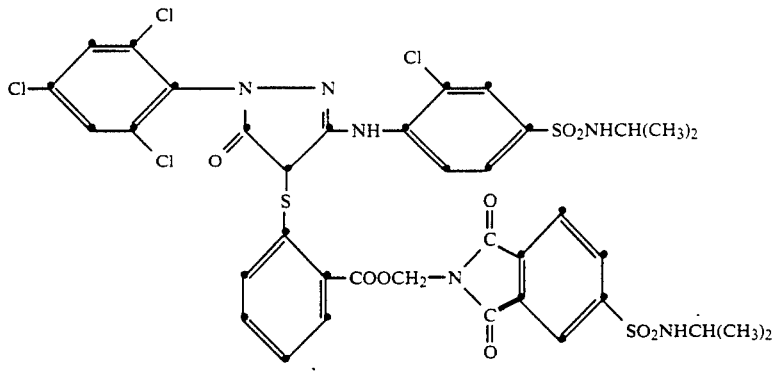

Coupler 3

Part B 10 g (0.01 mole) of disulfide S-7 was suspended in 100 ml of chloroform and 1 g of chlorine gas was bubbled into the suspension. A yellow solution formed which was concentrated to dryness under reduced pressure and ambient temperature to give a yellow tar which was redissolved in 50 ml of chloroform. This sulfenyl chloride was added in a thin stream with vigorous stirring to 10.2 g (0.02 mole) of Coupler M dissolved in 150 ml of dry DMF that had been cooled to 0° C.

The mixture was allowed to warm to room temperature, then drowned in water containing NaCl; the chloroform layer was collected and concentrated to an oil under reduced pressure. This oil was then drowned in water to give a gummy solid which, after collecting and dissolving in dichloromethane, was chromatographed over magnesium silicate to give a pale yellow solid; recrystallization of this material from acetonitrile gave 4.3 g (0.0046 mole) of Coupler 3 as white solid, m.p. 153° C.

The NMR spectrum was consistent with the assigned structure. Anal. calcd. for $C_{37}H_{32}Cl_4N_6O_9S_3$: C, 49.7; H, 3.1; N, 8.5. Found: C, 48.9; H, 2.8; N, 8.3.

SYNTHESIS EXAMPLE 4: PREPARATION OF

-continued

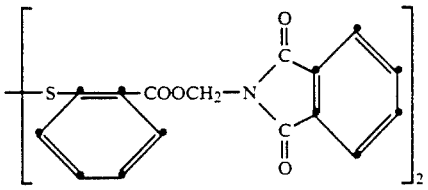

S-8

15.3 g (0.05 mole of S-6 (Example 3) and 25 g (0.1 mole) of S-2 (Example 1) were dissolved in 250 ml of dry DMF containing 15 g (0.12 mole) of Hunig's base and the solution was stirred overnight during which time a precipitate formed. This material was collected and washed with water, then THF, and then dried to give 17 g (0.027 mole) of a white solid S-8, m.p. >220° C.

The mass spectrum was consistent with the above structure. Anal. calcd. for $C_{32}H_{20}N_2O_8S_2$: C, 61.5; H, 3.2; N, 4.5. Found: C, 60.4; H, 3.8; N, 5.1.

Part B: Preparation of the Coupler

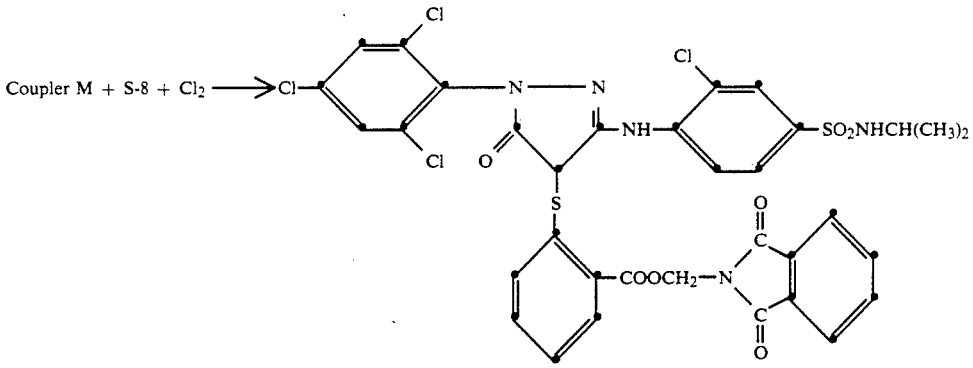

Coupler 4

Part B of Synthesis Example 3 was repeated using 10.2 g (0.02 mole) of Coupler M, 6.2 g (0.01 mole) of disulfide S-8, and 1 g (0.014 mole) of chlorine gas.

After chromatography the product was crystallized from benzene and then recrystallized from acetonitrile to give 8 g (0.0097 mole) of a white solid, Coupler 4, m.p. 121.5°-122.5° C.

COUPLER 4

Part A: Preparation of Disulfide S-8

Compound S-6 + Compound S-2 $\xrightarrow[\text{DMF}]{\text{base}}$

The NMR was consistent with the assigned structure. Anal. calcd. for $C_{34}H_{25}Cl_4N_5O_7S_2$: C, 49.7; H, 3.1; N, 8.5. Found: C, 49.3; H, 3.5; N, 9.1.

The coupler of this invention can be incorporated in silver halide emulsions and the emulsions can be coated on a support to form a photographic element. Alternatively, the coupler can be incorporated in the photographic element adjacent to the silver halide emulsion where, during development, the coupler will be in reactive association with development products such as oxidized color developing agent.

The photographic elements in which the couplers of this invention are employed can be either single color or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the elements of this invention, reference will be made to *Research Disclosure*, December 1978, Item 17643, published by Kenneth Mason Publications, Ltd., Dudley Annex, 21a North Street, Emsworth, Hampshire PO10 7DQ, ENGLAND, the disclosures of which are incorporated herein by reference. This publication will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in U.S. Pat. Nos. 4,379,837; 4,444,877; 4,665,012; 4,686,178; 4,565,778; 4,728,602; 4,668,614; and 4,636,461; and published applications EP 264,954, GB 1,027,146; and JA 54/48,521. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure*, Section IV.

Suitable vehicles for the emulsion layers and other layers of elements of this invention are described in *Research Disclosure*, Section IX and the publications cited therein.

In addition to the couplers described herein the elements of this invention can include additional couplers as described in *Research Disclosure*, Section VII, paragraphs D, E, F and G and the publications cited therein. These additional couplers can be incorporated as described in *Research Disclosure*, Section VII, paragraph C and the publications cited therein.

The photographic elements of this invention can contain brighteners (*Research Disclosure*, Section V), antifoggants and stabilizers (*Research Disclosure*, Section VI), antistain agents and image dye stabilizers (*Research Disclosure*, Section VII, paragraphs I and J), light absorbing and scattering materials (*Research Disclosure*, Section VIII), hardeners (*Research Disclosure*, Section X), coating aids (*Research Disclosure*, Section XI), plasticizers and lubricants (*Research Disclosure*, Section XII), antistatic agents (*Research Disclosure*, Section XIII), matting agents (*Research Disclosure*, Section XVI) and development modifiers (*Research Disclosure*, Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluenesulfonic acid.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the steps of bleaching, fixing, or bleach-fixing, to remove silver and silver halide, washing, and drying.

Typical bleach baths contain an oxidizing agent to convert elemental silver, formed during the development step, to silver halide. Suitable bleaching agents include ferricyanides, dichromates, ferric complexes of aminocarboxylic acids and persulfates.

Fixing baths contain a complexing agent that will solubilize the silver halide in the element and permit its removal from the element. Typical fixing agents include thiosulfates, bisulfites, and ethylenediamine tetraacetic acid.

In some cases the bleaching and fixing baths are combined in a bleach/fix bath.

Depending upon the particular coupler employed, the specific composition of the processing solutions and the residence time of the element in the processing solutions, the couplers of this invention can be converted to the removable form and removed in one of the processing baths used to perform the conventional functions of development, bleaching, and fixing or bleach-/fixing. However, due to the possibility of reaction between removed coupler and components of the processing composition, it is preferred that at least the removal step, and preferably both the conversion and removal steps, be performed in a separate solution. Typically this will be an aqueous alkaline solution, in which the element is placed for a time sufficient to convert and remove coupler which has not reacted to form dye. This step can be between other processing steps, e.g. after development but before bleaching or fixing, but preferably follows bleaching and fixing. A suitable solution comprises an aqueous solution of sodium hydroxide buffered to a pH in the range of 10–13 with a phosphate buffer. Residence times in the solution of several seconds to several minutes, e.g. 30 seconds to 30 minutes may be needed to remove unreacted coupler. The length of time will depend on the composition of the solution, the particular coupler being removed and the amount to be removed.

The following examples further illustrate this invention. In these examples, comparative couplers having the following structures were employed:

Coupler C-1:

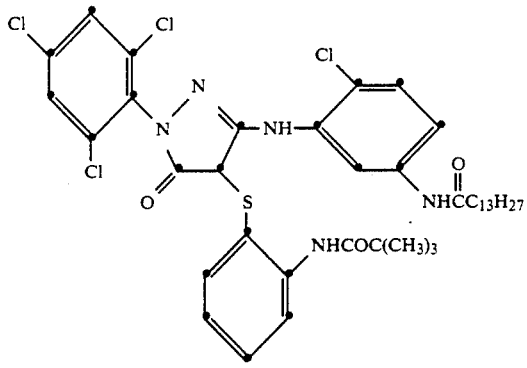

Coupler C-2:

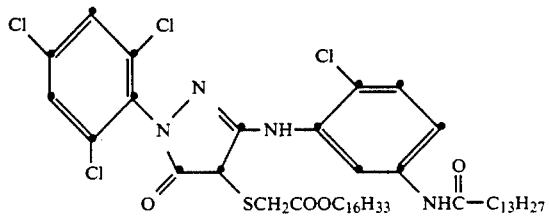

Coupler C-3:

-continued

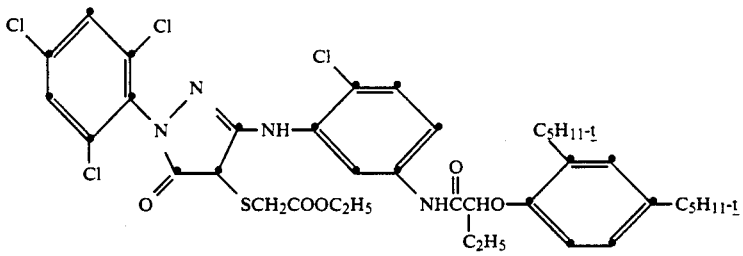

EXAMPLE 1

Photographic elements were prepared by coating a gelatin-subbed, polyethylene-coated paper support with a photosensitive layer containing a silver chloride emulsion at 0.172 g Ag/m$^2$, gelatin at 1.238 g/m$^2$, and one of the magenta couplers as shown in Tables 1–3 at 0.38 mmol/m$^2$ dispersed in the phosphate ester identified below as A-1 at 50% by weight of coupler. Each coupler dispersion also contained the following addenda (weight percent of coupler): A-2 (32%), A-3 (16%), and ethyl acetate (300%). The photosensitive layer was overcoated with a protective layer containing gelatin at 1.08 g/m$^2$ and bis(vinylsulfonylmethyl) ether hardener at 2% by weight based on total gelatin.

Addendum A-1:

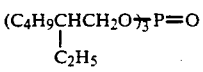

Addendum A-2:

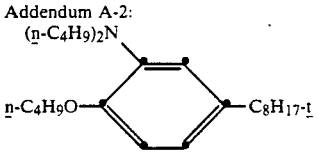

Addendum A-3:

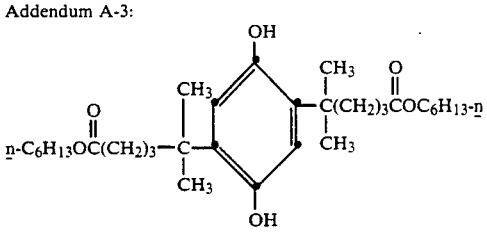

Samples of each element were imagewise exposed through a graduated density test object, then processed at 35° C. for 45 seconds in the color developer shown below, 45 seconds in the bleach-fix bath shown below, then washed and dried. Additional samples of each element were exposed and processed as above, except that after the bleach-fix step, the samples were bathed in an aqueous sodium hydroxide bath at pH 11 for 15 minutes.

| Color Developer (pH 10.12) | |
|---|---|
| Triethanolamine | 11.0 mL |
| Diethylhydroxylamine sulfate (85%) | 6.0 mL |
| Lithium sulfate | 2.7 g |
| 1-Hydroxyethylene-1,1-diphosphonic acid (60% solution) | 0.8 mL |
| 4-Amino-3-methyl-N-ethyl-N-(β-methanesulfonamido)ethylaniline sulfate hydrate | 4.85 g |

-continued

| | |
|---|---|
| Potassium carbonate | 25.0 g |
| Potassium chloride | 1.8 g |
| Potassium bromide | 0.02 g |
| Stilbene stain-reducing agent | 2.3 g |
| Surfactant | 0.25 mL |
| Water to make | 1.0 L |
| **Bleach-Fix Bath (pH 6.2)** | |
| Ammonium thiosulfate | 61.4 g |
| Ethylenediamine tetraacetic acid | 2.3 g |
| Ferric ammonium EDTA | 41.4 g |
| Sodium metabisulfite | 8.3 g |
| Acetic acid (glacial) | 8.7 g |
| Water to make | 1.0 L |

In order to test the resistance to formation of background stain (yellowing), film strips of each coating developed normally (pH 10) or given an additional post-development alkaline treatment (pH 11) were subjected to the following accelerated keeping tests. Then the increase in density to blue light was measured and the difference between the pH 11 and the pH 10 treatment determined.

a. Photochemical yellowing: 4 week 50 Klux xenon light exposure b. High humidity yellowing: 4 week incubation at 60° C./70% RH c. Thermal yellowing: 4 week incubation at 77° C. (dry oven)

The results are presented in Tables 1, 2, and 3:

TABLE 1

| Photochemical Yellowing (Δ Blue Density) | | | | |
|---|---|---|---|---|
| Sample | Coupler | pH 10 | pH 11 | Difference |
| 1. Comp. | C-1 | 0.08 | 0.08 | 0 |
| 2. Comp. | C-2 | 0.13 | 0.12 | −0.01 |
| 3. Comp. | C-3 | 0.10 | 0.12 | +0.02 |
| 4. Invn. | 3 | 0.02 | 0.03 | +0.01 |
| 5. Invn. | 2 | 0.02 | 0 | −0.02 |
| 6. Invn. | 4 | 0.04 | 0.02 | −0.02 |
| 7. Invn. | 1 | 0.05 | 0.02 | −0.03 |

TABLE 2

| High Humidity Yellowing (Δ Blue Density) | | | | |
|---|---|---|---|---|
| Sample | Coupler | pH 10 | pH 11 | Difference |
| 1. Comp. | C-1 | 0.09 | 0.12 | +0.03 |
| 2. Comp. | C-2 | 0.12 | 0.31 | +0.19 |
| 3. Comp. | C-3 | 0.17 | 0.21 | +0.04 |
| 4. Invn. | 3 | 0.07 | 0.04 | −0.03 |
| 5. Invn. | 2 | 0.10 | 0.06 | −0.04 |
| 6. Invn. | 4 | 0.05 | 0.05 | 0 |
| 7. Invn. | 1 | 0.07 | 0.06 | −0.01 |

TABLE 3

| Thermal Yellowing (Δ Blue Density) | | | | |
|---|---|---|---|---|
| Sample | Coupler | pH 10 | pH 11 | Difference |
| 1. Comp. | C-1 | 0.16 | 0.16 | 0 |

TABLE 3-continued

| Sample | Coupler | Thermal Yellowing (Δ Blue Density) pH 10 | pH 11 | Difference |
|---|---|---|---|---|
| 2. Comp. | C-2 | 0.33 | 0.33 | 0 |
| 3. Comp. | C-3 | 0.30 | 0.28 | −0.02 |
| 4. Invn. | 3 | 0.28 | 0.05 | −0.23 |
| 5. Invn. | 2 | 0.15 | 0.04 | −0.11 |
| 6. Invn. | 4 | 0.31 | 0.05 | −0.26 |
| 7. Invn. | 1 | 0.16 | 0.06 | −0.10 |

It can be seen from the data in Tables 1–3 that samples 4–7 containing the couplers of the invention, when treated after development with a pH 11 alkaline bath, show much smaller increases in background yellowing under each of the test conditions than samples 1–3 containing comparison couplers. Values in the "Difference" column show the added effect on stain reduction of the post-development bath over the normal development process. These results indicate that the undesirable stain which can arise from residual unreacted couplers is minimized when couplers of the invention are removed from the photographic element during processing.

EXAMPLE 2

Samples of each of the unexposed elements from Example 1 and of background areas of the elements exposed and processed with and without the pH 11 alkaline bath, as described in Example 1, were analyzed for residual coupler. A 5 $cm^2$ sample of each element was subjected to enzymatic extraction by a 1:1 protease:water mixture, and the amount of residual coupler was determined by high pressure liquid chromatography.

The results are shown in Table 4. It will be observed that with the comparative couplers there is no significant difference in the amount of residual coupler, while with the couplers of the invention, the alkaline bath substantially removes the coupler. In fact, in two cases substantial removal of the residual coupler is accomplished without the need for the additional alkaline bath.

TABLE 4

| Sample | Cplr. | Residual Coupler in $mg/m^2$ Unprocessed Element | Without pH 11 Bath | With pH 11 Bath | % Cplr. Removed |
|---|---|---|---|---|---|
| 1. | C-1 | 344 | 344 | 344 | 0 |
| 2. | C-2 | 409 | 431 | 420 | 0 |
| 3. | C-3 | 301 | 334 | 291 | 3 |
| 4. | 3 | 366 | 323 | 11 | 97 |
| 5. | 2 | 183 | 57 | not detd. | |
| 6. | 4 | 355 | 344 | 28 | 92 |
| 7. | 1 | 248 | 40 | 16 | 94 |

The invention has been described in detail with particular reference to preferred embodiments thereof, but it will be understood that variations and modifications can be effected within the spirit and scope of the invention.

What is claimed is:

1. A photographic element comprising a support, a silver halide emulsion, and a non-diffusible coupler compound that, during photographic processing is converted to a form that can be removed from the element if it has not reacted with oxidized silver halide color developing agent, the coupler compound having the structure:

COUP—LS—BAL wherein:

COUP represents a coupler moiety,

LS represents a splittable linking group attached to a non-coupling position of COUP wherein splitting of LS occurs by hydrolysis of an amidomethyl ester, a beta-keto ester, a gamma-keto ester, a ketal, or an acetal, and BAL is an organic ballast group.

2. A photographic element of claim 1 wherein COUP represents a coupler moiety that when reacted with oxidized color developing agent gives a colorless reaction product, or one that is removable from the element during further processing when there is joined to the coupling position of COUP a photographically useful group.

3. A photographic element of claim 1 wherein splitting of the group LS leaves on the coupler compound a solubilizing residue.

4. A photographic element of claim 3, wherein the solubilizing residue is an acid group.

5. A photographic element of claim 4, wherein the solubilizing residue is a carboxy group.

6. A photographic element comprising a support, a silver halide emulsion, and a non-diffusible coupler compound that, during photographic processing is converted to a form that can be removed from the element if it has not reacted with oxidized silver halide color developing agent, the coupler compound having the structure

COUP—LS—BAL wherein:

COUP represents a coupler moiety,

BAL is an organic ballast group and

LS represents a splittable linking group attached to a non-coupling position of COUP wherein splitting of the linking group occurs during photographic processing and involves one of the following reactions a) Hydrolysis of a phthalimidomethyl ester:

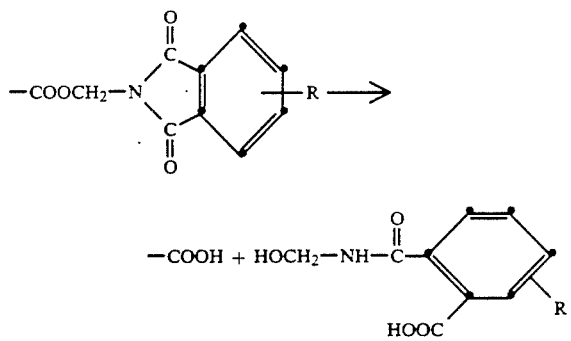

b) Hydrolysis of a keto ester:

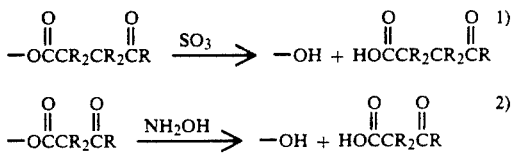

c) Oxidative cleavage of a diketone:

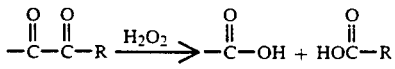

d) Hydrolysis of a ketal or acetal:

1)

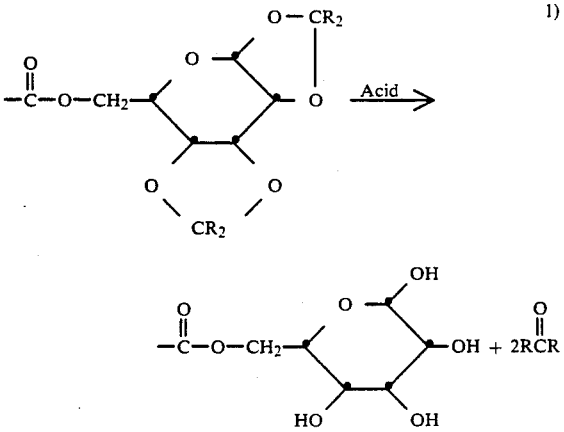

2)

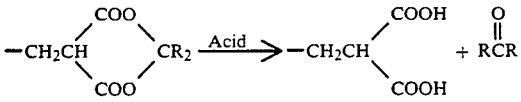

3)

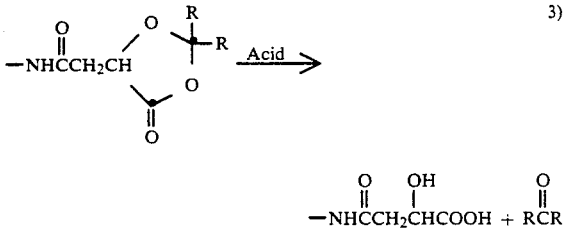

e) Hydrolysis following oxidation:

1)

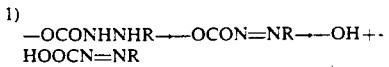

f) Fluoride-catalyzed siloxy bond cleavage:

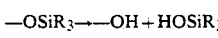

g) Anchimerically assisted base-catalyzed hydrolysis:

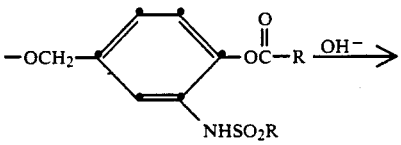

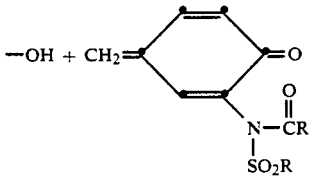

wherein R is hydrogen or one or more substituents, at least one of which is BAL.

7. A process of forming an image in an imagewise exposed photographic element of any one of claims 1 or 6, which comprises developing the element with a color developing agent to form a visible image and removing from the element coupler compound that has not reacted with oxidized color developing agent.

8. A process of claim 7 wherein removal of the unreacted coupler compound occurs in a step separate from the development step.

9. A process of claim 7 wherein removal of the unreacted coupler compound occurs in a step separate from the development, bleach and fix, or bleach/fix steps.

* * * * *